US006456006B1

(12) United States Patent
Torisaki

(10) Patent No.: US 6,456,006 B1
(45) Date of Patent: Sep. 24, 2002

(54) PLASMA DISPLAY PANEL HAVING ELECTRODES CONFIGURED TO REDUCE ELECTRIC CONSUMPTION

(75) Inventor: Yasuhiro Torisaki, Yamanashi (JP)

(73) Assignee: Pioneer Corporation, Tokyo (JP)

( * ) Notice: Subject to any disclaimer, the term of this patent is extended or adjusted under 35 U.S.C. 154(b) by 231 days.

(21) Appl. No.: 09/604,170

(22) Filed: Jun. 27, 2000

(30) Foreign Application Priority Data

Aug. 18, 1999 (JP) ..... 11-231242

(51) Int. Cl.[7] ..... H01J 17/49
(52) U.S. Cl. ..... 313/582; 313/584; 313/586
(58) Field of Search ..... 313/582–587

(56) References Cited

U.S. PATENT DOCUMENTS 5,640,068 A * 6/1997 Amemiya ..... 313/582
5,656,893 A * 8/1997 Shino et al. ..... 313/169.4
6,255,779 B1 * 7/2001 Ha et al. ..... 313/582
6,348,762 B1 * 2/2002 Nunomura et al. ..... 313/582
6,376,986 B1 * 4/2002 Takagi et al. ..... 313/582

* cited by examiner

*Primary Examiner*—Robert H. Kim
*Assistant Examiner*—Jurie Yun
(74) *Attorney, Agent, or Firm*—Morgan, Lewis & Bockius LLP

(57) ABSTRACT

A plasma display panel is configured to reduce an electric power consumption. Transparent electrodes for discharging are provided so that their areas gradually decrease from the center portion of the display screen of the PDP toward the peripheral portion thereof.

6 Claims, 6 Drawing Sheets

| | 1ST DIS-CHARGE CELL | 2ND DIS-CHARGE CELL | 3RD DIS-CHARGE CELL | 4TH DIS-CHARGE CELL | AVERAGE AREA |
|---|---|---|---|---|---|
| REGION E1 | 10 | 10 | 9 | 11 | 10 |
| REGION E2 | 9 | 8 | 9 | 10 | 9 |
| REGION E3 | 9 | 7 | 8 | 8 | 8 |

| | 1ST DIS-CHARGE CELL | 2ND DIS-CHARGE CELL | 3RD DIS-CHARGE CELL | 4TH DIS-CHARGE CELL | AVERAGE AREA |
|---|---|---|---|---|---|
| REGION E1 | 10 | 10 | 9 | 11 | 10 |
| REGION E2 | 9 | 8 | 9 | 10 | 9 |
| REGION E3 | 9 | 7 | 8 | 8 | 8 |

PLASMA DISPLAY PANEL HAVING ELECTRODES CONFIGURED TO REDUCE ELECTRIC CONSUMPTION

BACKGROUND OF THE INVENTION

1. Field of the Invention

The invention relates to a color display plasma display panel (hereinafter, referred to as PDP) as a self light emitting type flat display using a gas discharge.

2. Description of Related Art

In recent years, in accordance with the increase in size of a display apparatus, a demand for thin display apparatuses is growing and various thin display apparatuses have been put into practical use. AC (alternate current discharge) type PDP is drawing attention in this field as one of the thin display apparatuses.

In an AC type PDP, a plurality of sets of row electrode pairs corresponding to "rows" of a screen are provided on one of two glass substrates which face each other and a plurality of column electrodes corresponding to "columns" are provided on the other glass substrate. Further, a mixture of rare gases containing mainly neon, xenon, and the like is sealed between both of the glass substrates. A discharge cell corresponding to one pixel is formed in each crossing portion of the row electrodes and the column electrodes.

To allow the PDP to execute a light emission display, a voltage is applied across the pair of row electrodes and only the discharge cells corresponding to an input video signal among the discharge cells formed in the crossing portions are allowed to perform a discharge light emission, thereby obtaining a display image corresponding to the input video signal. In this structure, a current flows between the electrodes in accordance with the applied voltage, and electric power is consumed by the resistance which the electrodes have.

OBJECTS AND SUMMARY OF THE INVENTION

It is an object of the invention to provide a plasma display panel which can reduce an electric power consumption.

According to the first aspect of the invention, there is provided a plasma display panel comprising: a front glass substrate serving as a display screen; a plurality of row electrodes arranged in parallel on the inner surface of the front glass substrate; a back glass substrate; a plurality of column electrodes arranged on the inner surface of the back glass substrate so as to be extended in the direction which crosses the row electrodes; and a discharge space which is formed between the front glass substrate and the back glass substrate and in which a discharge gas is sealed, wherein each of the row electrodes is constituted by a transparent electrode for performing a discharge and a bus electrode for supplying a voltage to the transparent electrode, and an area of each of the transparent electrodes gradually decreases from a center portion of the display screen to the peripheral portion thereof.

According to the second aspect of the invention, there is provided a plasma display panel comprising: a front glass substrate serving as a display screen; a plurality of row electrodes arranged in parallel on the inner surface of the front glass substrate; a back glass substrate; a plurality of column electrodes arranged on the inner surface of the back glass substrate so as to be extended in the direction which crosses the row electrodes; and a discharge space which is formed between the front glass substrate and the back glass substrate and in which a discharge gas is sealed, wherein each of the row electrodes is constituted by a transparent electrode for performing a discharge and a bus electrode for supplying a voltage to the transparent electrode, the display screen is divided into a plurality of regions, and an average area of the transparent electrodes existing in each of the regions gradually decreases from a center region of the display screen to the peripheral region thereof.

DETAILED DESCRIPTION OF THE PREFERRED EMBODIMENTS

Figure 1:
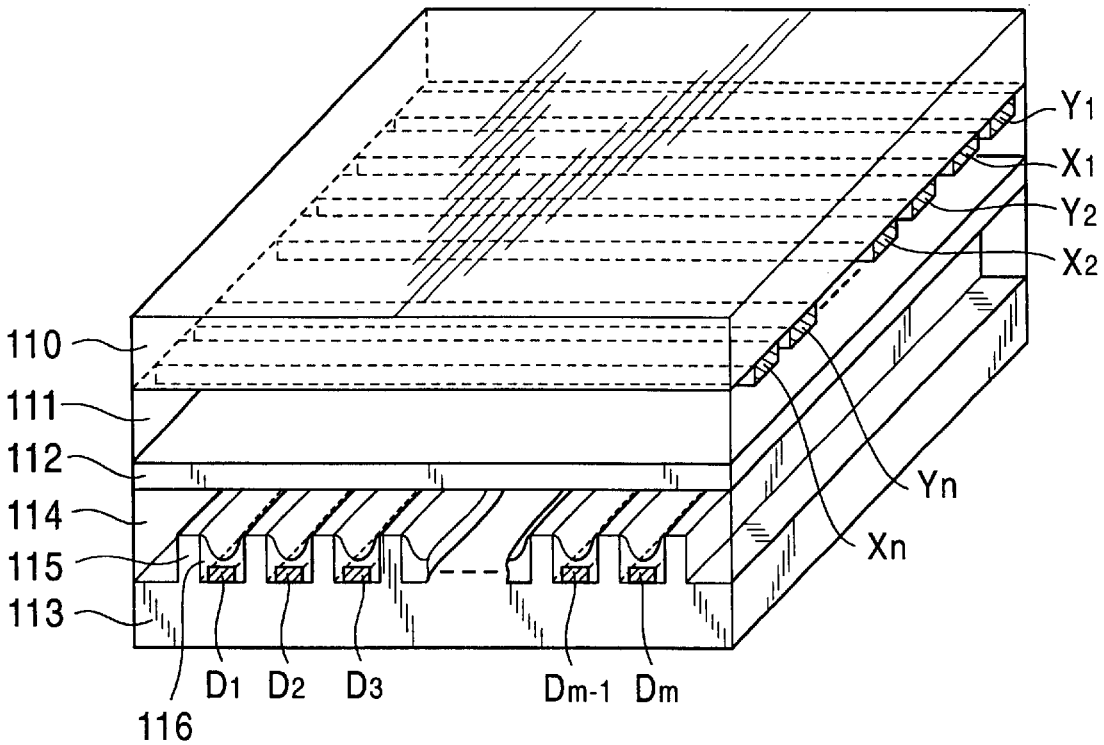
FIG. 1 RELATED ART
FIG. 1 is a diagram showing a schematic construction of an AC type PDP.

FIG. 1 is a diagram showing a schematic construction of an AC type PDP.

In FIG. 1, n row electrodes $X_1$ to $X_n$ and row electrodes $Y_1$ to $Y_n$ are alternately arranged in parallel on an inner surface (surface which faces a back glass substrate 113, which will be explained later) of a front glass substrate 110 serving as an image display surface, respectively. In this structure, one row of the screen of the PDP is formed by a pair of row electrodes X and Y.

The row electrodes $X_1$ to $X_n$ and row electrodes $Y_1$ to $Y_n$ are covered by a dielectric material layer 111 on which a protecting layer 112 made of magnesium oxide or the like has been deposited by an evaporation deposition method. A discharge space 114 is provided in which a mixture of rare gases containing mainly neon, xenon, and the like is sealed as a discharge gas. The discharge space 114 is formed between the dielectric material layer 111 and the back glass substrate 113. Column electrodes $D_1$ to $D_m$ are formed on an inner surface (surface which faces the front glass substrate 110) of the back glass substrate 113 so as to be extended in the direction which crosses the row electrodes $X_1$ to $X_n$ and row electrodes $Y_1$ to $Y_n$. The column electrodes $D_1$ to $D_m$ are separated by a barrier 115 as shown in FIG. 1. Further, a fluorescent material layer 116 for performing a blue light emission, a green light emission, or a red light emission is formed so as to cover each column electrode D and the wall surfaces of the barrier 115.

A discharge cell corresponding to one pixel is formed in each of crossing portions of the column electrode D and the row electrodes X and Y.

That is, the blue discharge cells are formed in the crossing portions of the column electrode D and the row electrodes X and Y where the fluorescent material layer 116 for performing the blue light emission has been formed. The green discharge cells are formed in the crossing portions of the column electrode D and the row electrodes X and Y where the fluorescent material layer 116 for performing the green light emission has been formed. Further, the red discharge cells are formed in the crossing portions of the column electrode D and the row electrodes X and Y where the fluorescent material layer 116 for performing the red light emission has been formed.

Figure 2:
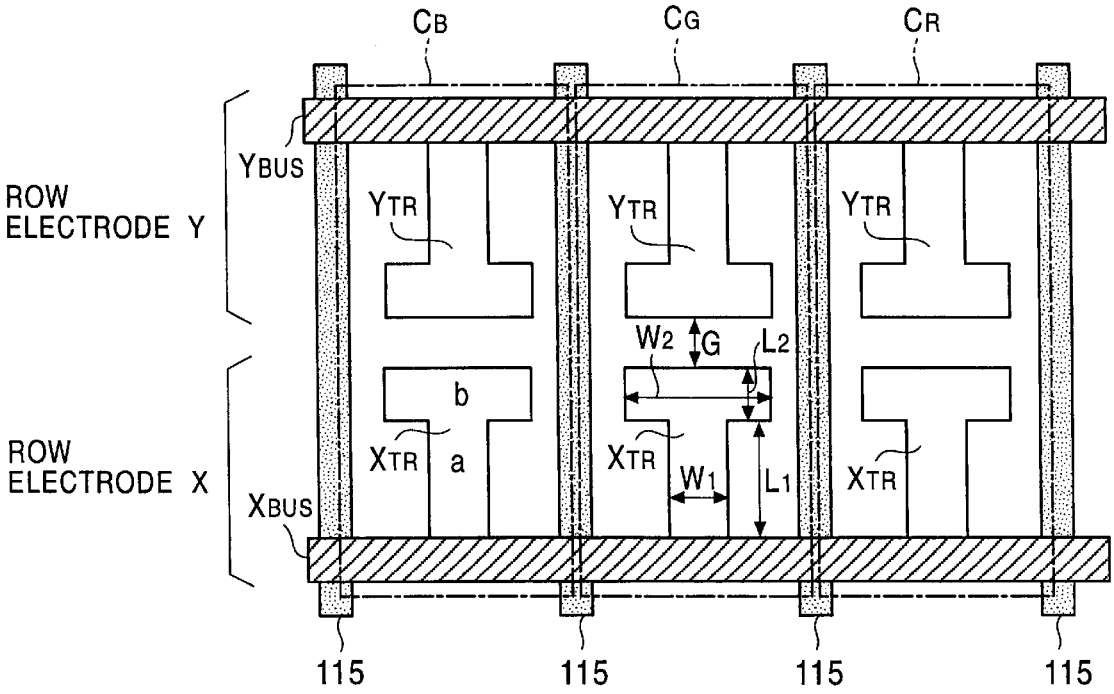
FIG. 2 RELATED ART
FIG. 2 is a diagram showing the structure of each of adjacently formed blue discharge cell, green discharge cell, and red discharge cell which are extracted for the purpose of illustration from the PDP shown in FIG. 1.

FIG. 2 is a diagram showing only three discharge cells comprising a blue discharge cell, a green discharge cell, and a red discharge cell which are adjacently formed, in which these cells are extracted from the PDP shown in FIG. 1 and shown. FIG. 2 is a diagram when it is seen from the display surface side of the front glass substrate 110 in the PDP shown in FIG. 1.

As shown in FIG. 2, a T-shaped transparent electrode $X_{TR}$ is formed on each of a blue discharge cell $C_B$, a green discharge cell $C_G$, and a red discharge cell $C_R$. Each of the transparent electrodes $X_{TR}$ is connected to one bus electrode $X_{BUS}$. The row electrode X corresponding to one row is formed by the bus electrode $X_{BUS}$ and the plurality of transparent electrodes $X_{TR}$ connected thereto. A transparent T-shaped transparent electrode $Y_{TR}$ is formed on each of the blue discharge cell $C_B$, green discharge cell $C_G$, and red discharge cell $C_R$. Each of the transparent electrodes $Y_{TR}$ is connected to one bus electrode $Y_{BUS}$ The row electrode Y corresponding to one row is formed by the bus electrode $Y_{BUS}$ and the plurality of transparent electrodes $Y_{TR}$ connected thereto. Each of the pair of transparent electrodes $Y_{TR}$ and $X_{TR}$ comprises a narrow width portion a and a wide width portion b which are extended along the barrier 115. One end of the narrow width portion a of each of the transparent electrodes $Y_{TR}$ and $X_{TR}$ is electrically connected to each bus electrode ($Y_{BUS}$, $X_{BUS}$). The wide width portions b of the transparent electrodes $Y_{TR}$ and $X_{TR}$ are formed at positions which are away from each other by a predetermined distance G. This space becomes a discharge gap. That is, when a voltage is applied across the bus electrodes $Y_{BUS}$ and $X_{BUS}$, this voltage is supplied to the transparent electrodes $Y_{TR}$ and $X_{TR}$ and a discharge is generated in the discharge gap.

The blue discharge cell $C_B$, green discharge cell $C_G$, and red discharge cell $C_R$ having the row electrodes X and Y having the electrode form as shown in FIG. 2 are arranged in a matrix shape in the PDP.

In the PDP according to the invention, the areas of the transparent electrodes $Y_{TR}$ and $X_{TR}$ formed in each discharge cell gradually decrease from the center portion of the display screen to the peripheral portion thereof.

Figures 3, 4:
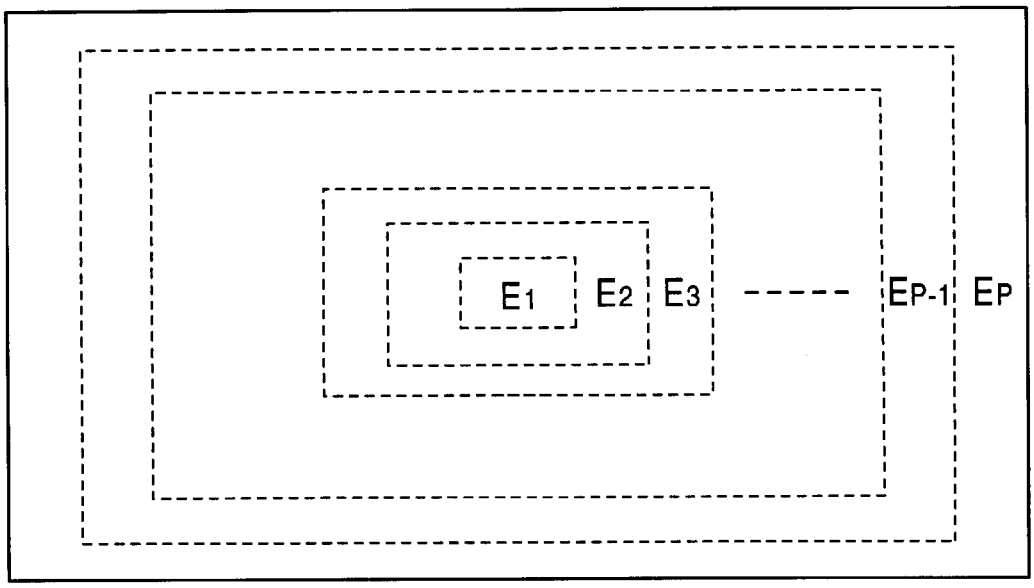
FIG. 3 is a diagram for explaining a correspondence between regions in the display screen of the PDP and an area of a transparent electrode in the discharge cell existing in each region.
FIG. 4 is a diagram showing an example of an area of the transparent electrode in each of the four discharge cells existing in each of regions $E_1$ to $E_3$ of the PDP shown in FIG. 3 and an average area of the transparent electrodes in each region.

That is, the area of each of the transparent electrodes $Y_{TR}$ and $X_{TR}$ gradually decreases from that existing in a center region $E_1$ of the display screen of the PDP to those existing in regions $E_2$, $E_3$, . . . , and $E_P$ as shown in FIG. 3. As a method of decreasing the areas of the transparent electrodes $Y_{TR}$ and $X_{TR}$, for example, an electrode width $W_1$ in the narrow width portion a, an electrode width $W_2$ in the wide width portion b, and the discharge gap G shown in FIG. 2 are set to fixed widths, respectively, and an electrode length $L_2$ in the wide width portion b is set to be short while an electrode length $L_1$ in the narrow width portion a is set to be long.

By sequentially reducing the areas of the transparent electrodes $Y_{TR}$ and $X_{TR}$ which are formed in the discharge cell existing in the peripheral region of the screen as the region approaches the periphery as mentioned above, the electric power consumption is also reduced by an amount corresponding to the reduced amount of the areas of the transparent electrodes as resistors. Although the luminance in the screen peripheral portion is reduced by an amount corresponding to the reduced areas of the transparent electrodes $Y_{TR}$ and $X_{TR}$ as compared with that in the center portion of the screen, a display image in the peripheral portion of the screen is not so significant on the sense of sight.

According to the invention, therefore, the electric power consumption can be reduced without deteriorating the picture quality.

If a luminance change ratio according to an area change of the transparent electrodes as mentioned above is larger than a display gradation due to an influence by a variation or the like of processing precision at the time of formation of the transparent electrodes $Y_{TR}$ and $X_{TR}$, there is a possibility of occurrence of a luminance variation.

An average area of the transparent electrodes $Y_{TR}$ and $X_{TR}$ in each of the regions $E_1$ to $E_P$ as shown in FIG. 3, therefore, gradually decreases from the region $E_1$ in the center portion of the screen toward the region $E_P$ in the peripheral portion of the screen.

For example, as shown in FIG. 4, when four discharge cells comprising the first to fourth discharge cells exist in the regions $E_1$ to $E_3$, an area of the transparent electrodes of the first discharge cell existing in the region $E_1$ is assumed to be "10", an area of the transparent electrodes of the second discharge cell is assumed to be "10", an area of the transparent electrodes of the third discharge cell is assumed to be "9", and an area of the transparent electrodes of the fourth discharge cell is assumed to be "11". The average area of the transparent electrodes in the region $E_1$ is, consequently, equal to "10". An area of the transparent electrodes of the first discharge cell existing in the region $E_2$ is assumed to be "9", an area of the transparent electrodes of the second discharge cell existing is assumed to be "8", an area of the transparent electrodes of the third discharge cell existing is assumed to be "9", and an area of the transparent electrodes of the fourth discharge cell existing is assumed to be "10". The average area of the transparent electrodes in the region $E_2$ is, consequently, equal to "9". An area of the transparent electrodes in the first discharge cell existing in the region $E_3$ is assumed to be "9", an area of the transparent electrodes in the second discharge cell existing is assumed to be "7", an area of the transparent electrodes in the third discharge cell existing is assumed to be "8", and an area of the transparent electrodes in the fourth discharge cell existing is assumed to be "8". The average area of the transparent electrodes in the region $E_3$ is, consequently, equal to "8".

As mentioned above, in the embodiment shown in FIG. 4, the average area of the transparent electrodes existing in the region sequentially decreases to "10", "9", and "8" from the center region $E_1$ of the screen toward the region $E_3$. As shown in FIG. 4, the third discharge cell having the transparent electrodes whose area is equal to "9" as an average area of the transparent electrodes in the adjacent region $E_2$ exists in the region $E_1$ in which the average area of the transparent electrodes is equal to "10". That is, the transparent electrodes having the same area are included in each of the adjacent regions.

In accordance with this construction, therefore, even if there is a variation or the like of the processing precision at the time of formation of the transparent electrodes, since the luminance change ratio according to the area change of the transparent electrodes as mentioned above is smaller than the display gradation, the luminance variation as mentioned above can be prevented.

Figure 5:
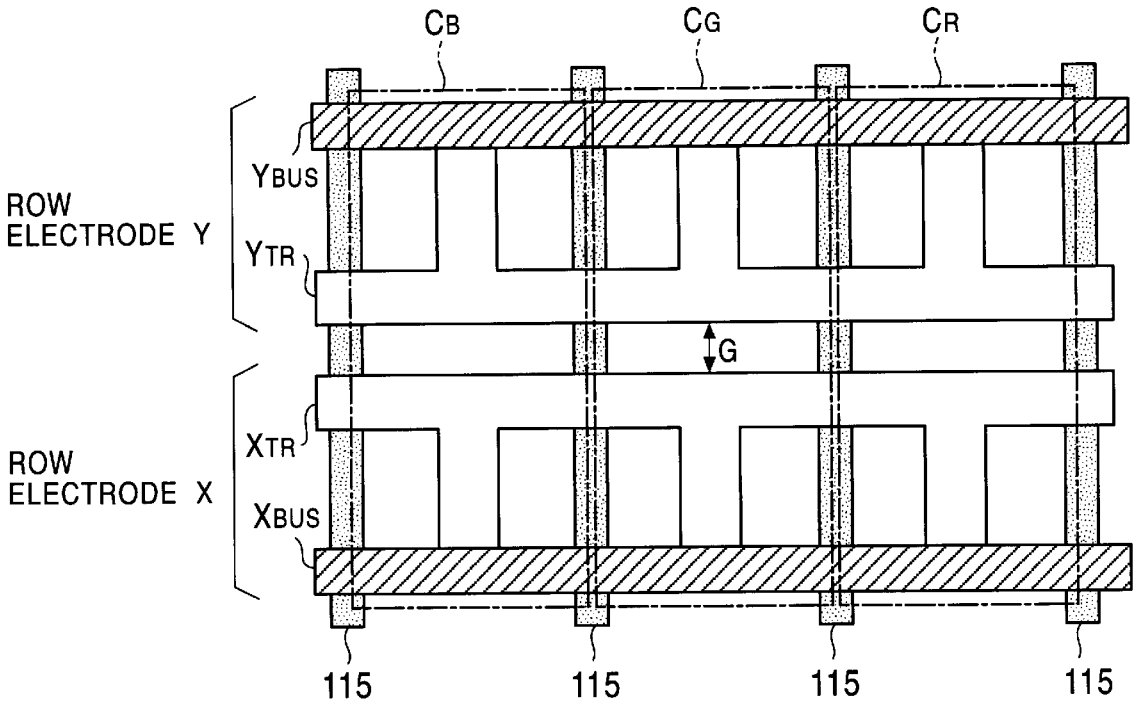
FIG. 5 is a diagram showing another structure of each of the blue discharge cell, green discharge cell, and red discharge cell.

In the embodiment shown in FIG. 2, although the T-shaped transparent electrodes $Y_{TR}$ and $X_{TR}$ are individually formed in each discharge cell, it is also possible to use a structure as shown in FIG. 5 in which the wide width portions b of the adjacent transparent electrodes $Y_{TR}$ and $X_{TR}$ formed every discharge cell are coupled.

Figure 6:
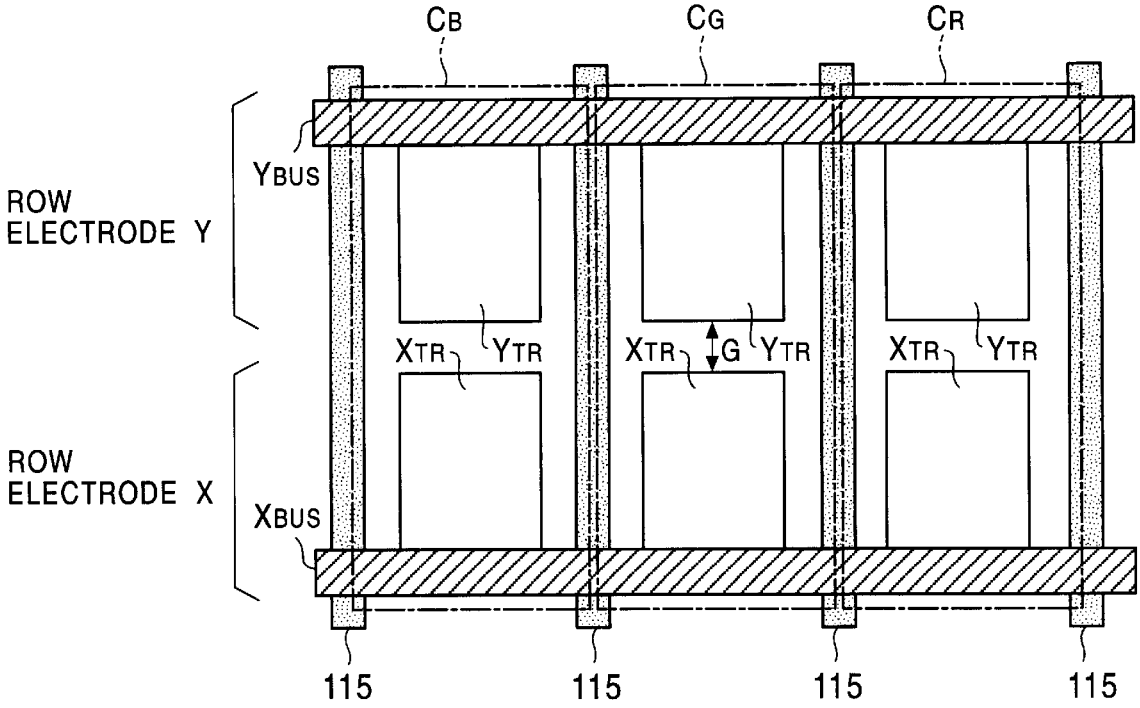
FIG. 6 is a diagram showing still another structure of each of the blue discharge cell, green discharge cell, and red discharge cell.

In place of the T-shaped transparent electrodes $Y_{TR}$ and $X_{TR}$ as shown in FIG. 2, rectangular transparent electrodes $Y_{TR}$ and $X_{TR}$ as shown in FIG. 6 can be also used. In brief, it is sufficient that independent island-shaped transparent electrodes are formed every discharge cell.

Figure 7:
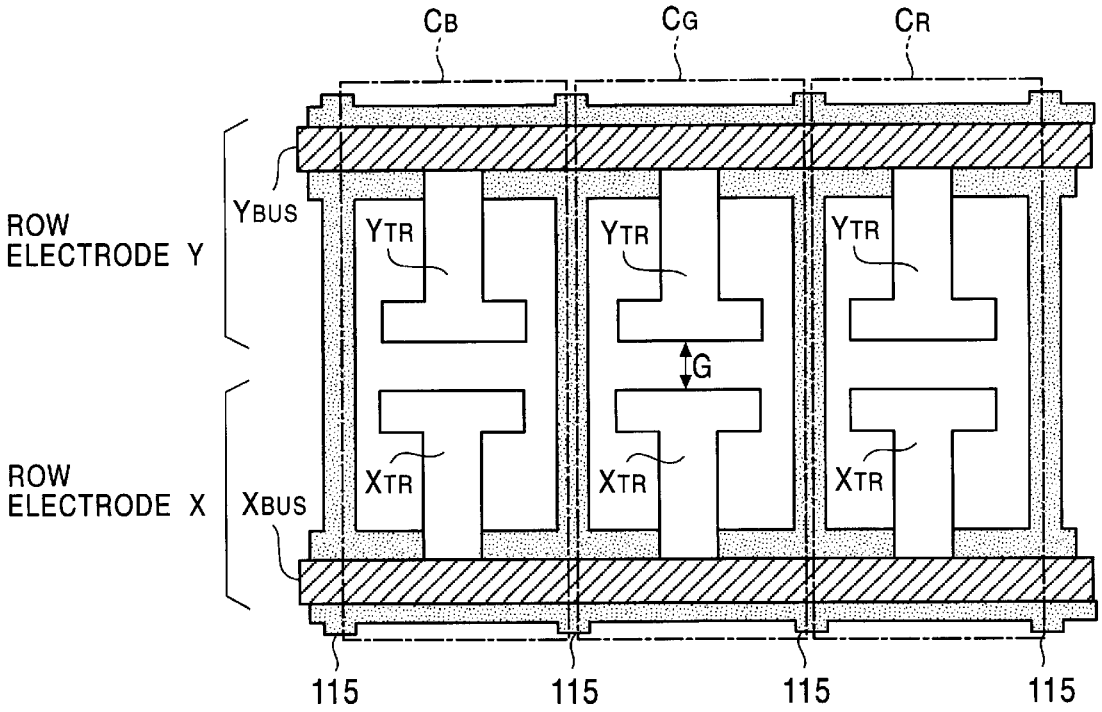
FIG. 7 is a diagram showing further another structure of each of the blue discharge cell, green discharge cell, and red discharge cell.

Further, as shown in FIG. 7, the barrier 115 can be also formed in parallel crosses so as to surround transparent electrodes $Y_{TR}$ and $X_{TR}$ formed in each discharge cell.

As described in detail above, in the plasma display panel according to the invention, since the areas of the transparent electrodes for discharging gradually decrease from the center portion of the display screen toward the peripheral portion thereof, the electric power consumption can be reduced without deteriorating the picture quality on the sense of sight.

What is claimed is:

1. A plasma display panel comprising:

a front glass substrate serving as a display screen;

a plurality of row electrodes arranged in parallel on an inner surface of said front glass substrate;

a back glass substrate;

a plurality of column electrodes arranged on an inner surface of said back glass substrate so as to be extended in the direction which crosses said row electrodes; and a discharge space which is formed between said front glass substrate and said back glass substrate and in which a discharge gas is sealed, wherein each of said row electrodes is constituted by a transparent electrode for performing a discharge and a bus electrode for supplying a voltage to said transparent electrode, and an area of each of said transparent electrodes gradually decreases from a center portion of said display screen to a peripheral portion thereof.

2. A panel according to claim 1, wherein a discharge cell corresponding to one pixel is formed in each crossing portion of said row electrodes and said column electrodes, and said transparent electrodes are a plurality of island-shaped transparent electrodes independently formed every said discharge cell.

3. A panel according to claim 2, wherein said island-shape is a T-shape.

4. A plasma display panel comprising:

a front glass substrate serving as a display screen;

a plurality of row electrodes arranged in parallel on an inner surface of said front glass substrate;

a back glass substrate;

a plurality of column electrodes arranged on an inner surface of said back glass substrate so as to be extended in the direction which crosses said row electrodes; and a discharge space which is formed between said front glass substrate and said back glass substrate and in which a discharge gas is sealed, wherein each of said row electrodes is constituted by a transparent electrode for performing a discharge and a bus electrode for supplying a voltage to said transparent electrode, and said display screen is divided into a plurality of regions, and an average area of said transparent electrodes existing in each of said regions gradually decreases from a center region of said display screen to a peripheral region thereof.

5. A panel according to claim 4, wherein a discharge cell corresponding to one pixel is formed in each crossing portion of said row electrodes and said column electrodes, and said transparent electrodes are a plurality of island-shaped transparent electrodes independently formed every said discharge cell.

6. A panel according to claim 5, wherein said island-shape is a T-shape.

* * * * *